US008757405B2

(12) United States Patent
Snyder

(10) Patent No.: US 8,757,405 B2
(45) Date of Patent: Jun. 24, 2014

(54) APPARATUS AND COMPOSITION FOR INHIBITING DENTAL CARIES

(71) Applicant: DrinkNRinse, LLC, Tucson, AZ (US)

(72) Inventor: Sharon L. Snyder, Tucson, AZ (US)

(73) Assignee: DrinkNRinse, LLC, Tucson, AZ (US)

( * ) Notice: Subject to any disclaimer, the term of this patent is extended or adjusted under 35 U.S.C. 154(b) by 0 days.

(21) Appl. No.: 13/751,813

(22) Filed: Jan. 28, 2013

(65) Prior Publication Data

US 2013/0228542 A1 Sep. 5, 2013

Related U.S. Application Data

(63) Continuation of application No. 13/410,152, filed on Mar. 1, 2012, now abandoned.

(51) Int. Cl.

| | |
|---|---|
| ***B65D 25/04*** | (2006.01) |
| ***B65D 30/22*** | (2006.01) |
| ***B65D 85/72*** | (2006.01) |
| ***A61J 9/00*** | (2006.01) |

(52) U.S. Cl.

USPC ..... 215/6; 215/11.3; 215/11.4; 220/501; 220/502; 206/219; 206/221; 383/38

(58) Field of Classification Search

USPC ..... 220/501, 502, 495.03, 495.06; 215/11.3, 11.4, 6, DIG. 8; 206/219, 206/221; 383/38

See application file for complete search history.

(56) References Cited

U.S. PATENT DOCUMENTS

| | | | | |
|---|---|---|---|---|
| 2,885,104 | A | 5/1959 | Greenspan | 215/6 |
| 4,608,043 | A * | 8/1986 | Larkin | 604/87 |
| 4,629,080 | A | 12/1986 | Carveth | 215/11 R |
| 4,711,359 | A | 12/1987 | White et al. | 215/11.1 |
| 4,856,995 | A | 8/1989 | Wagner | 433/215 |
| 4,961,495 | A | 10/1990 | Yoshida et al. | 206/219 |
| 5,060,811 | A | 10/1991 | Fox | 215/6 |
| 5,114,004 | A | 5/1992 | Isono et al. | 206/222 |
| 5,437,381 | A | 8/1995 | Herrmann | 215/11.1 |

(Continued)

FOREIGN PATENT DOCUMENTS

| | | | |
|---|---|---|---|
| CN | 201088495 | 7/2008 | A47J 41/02 |

OTHER PUBLICATIONS

Scheel et al., "Does the choice of bottle nipple affect the oral feeding performance of very-low-birthweight (VLBW) infants?", Acta Paediatrica, vol. 94, Issue 9, Sep. 2005, pp. 1266-1272 (16 pgs.).

(Continued)

*Primary Examiner* — Fenn Mathew
*Assistant Examiner* — Jennifer Castriotta
(74) *Attorney, Agent, or Firm* — Haynes Soloway P.C.

(57) ABSTRACT

A bottle liner or insert for administering at least two different liquids to a feeding child, includes a first reservoir of polymer fabric, the reservoir comprising two walls sealed together at their mutual bottom and sides and having an open top and flaps extending from both walls at the top of said first reservoir; a sheet of polymer fabric having a smaller area than either wall of said first reservoir, the sheet sealingly anchored to the inside of either wall such that the sheet and inner wall together form a second reservoir extending to and open at its top, the sheet also having a flap extending from its wall at the top; and a valve in fluid communication with and disposed between the first and second reservoirs.

13 Claims, 7 Drawing Sheets

(56) References Cited

U.S. PATENT DOCUMENTS

| | | | | |
|---|---|---|---|---|
| 5,593,052 | A | 1/1997 | McGee | 215/11.1 |
| 5,611,776 | A | 3/1997 | Simmons et al. | 604/65 |
| 5,617,972 | A | 4/1997 | Morano et al. | 221/33 |
| 5,638,968 | A | 6/1997 | Baron et al. | 215/11.4 |
| 5,758,786 | A | 6/1998 | John | 215/6 |
| 5,806,711 | A | 9/1998 | Morano et al. | 221/33 |
| 5,894,947 | A | 4/1999 | Morano | 215/11.3 |
| 5,897,007 | A | 4/1999 | Schein et al. | 215/11.1 |
| 5,954,230 | A * | 9/1999 | Blette et al. | 222/1 |
| 5,960,971 | A | 10/1999 | Bral | 215/11.4 |
| 6,110,091 | A | 8/2000 | Morano | 493/223 |
| 6,450,351 | B1 | 9/2002 | Thompson | 215/6 |
| 6,959,826 | B2 | 11/2005 | Knuth et al. | 215/11.1 |
| 7,017,770 | B2 | 3/2006 | Scheifele | 220/555 |
| 7,055,683 | B2 | 6/2006 | Bourque et al. | 206/219 |
| 7,073,674 | B2 | 7/2006 | Knuth et al. | 215/11.3 |
| 7,150,369 | B1 | 12/2006 | Fryar | 215/11.4 |
| 7,306,095 | B1 | 12/2007 | Bourque et al. | 206/219 |
| 7,331,478 | B2 | 2/2008 | Aljadi | 215/11.4 |
| 7,604,137 | B1 | 10/2009 | Boraca et al. | 215/6 |
| 2002/0035997 | A1 | 3/2002 | Shapira | 128/898 |
| 2003/0165792 | A1 | 9/2003 | Jodaikin et al. | 433/80 |
| 2005/0129338 | A1 | 6/2005 | Sprehe | 383/203 |
| 2006/0213857 | A1 | 9/2006 | Chen et al. | 215/11.1 |
| 2007/0189639 | A1 | 8/2007 | Revness | 383/37 |
| 2008/0179334 | A1 | 7/2008 | Abramson et al. | 220/568 |

OTHER PUBLICATIONS

Mathew, O.P., "Determinants of Milk Flow Through Nipple Units," vol. 144, No. 2, Feb. 1990, pp. 222-224 (3 pgs.).

Milgrom, et al., "Xylitol pediatric topical oral syrup to prevent dental caries: a double blind, randomized clinical trial of efficacy," Arch Pediatr Adolesc Med, vol. 163, No. 7, Jul. 2009, pp. 601-607 (11 pgs.).

Danhauer, et al., "Xylitol as a prophylaxis for acute otitis media: systematic review," Int J Audiol., vol. 49, No. 10, Oct. 2010, pp. 754-761 (abstract only-1 pg.).

International Search Report and the Written Opinion issued in the corresponding international application No. PCT/US2012/027332, dated May 30, 2012 (9 pgs).

* cited by examiner

APPARATUS AND COMPOSITION FOR INHIBITING DENTAL CARIES

CROSS-REFERENCE TO RELATED APPLICATIONS

This application is a continuation-in-part of our co-pending U.S. application Ser. No. 13/410,152, filed Mar. 1, 2012, which application in turn claims priority to and the benefit of U.S. Provisional Application Nos. 61/566,483, filed Dec. 2, 2011, 61/449,286 filed Mar. 4, 2011, and 61/449,457 filed Mar. 4, 2011, the contents of which are incorporated by reference herein in their entirety.

BACKGROUND

1. Field of the Invention

The embodiments of the present invention are directed to an apparatus and composition for inhibiting dental caries by a novel bottle insert system and anti-carie composition. More specifically, an embodiment is a two-reservoir drinking system that in a first reservoir allows a child to drink conventional nutritive and cariogenic liquids such as milk, juice and other sweetened drinks, and from a second reservoir introduces a rinse liquid for vulnerable young teeth, including water or a polyol-enhanced rinse agent that additionally has anti-cavity properties.

2. Description of Related Art

Babies are born with the instinct to suckle milk from their mothers' breasts, but it is often necessary for them to drink liquids from other sources. Babies are unable to drink liquids from glasses or cups without spilling so it is common throughout the world to feed liquids to babies in nursing bottles, also known as baby bottles. A nursing bottle features a rubber nipple with a small hole in its tip secured across an opening in the top of a liquid container. A nursing bottle is used by filling the container with liquid, securing the nipple, inverting the bottle, and placing the nipple into the baby's mouth. The baby then sucks on the nipple to withdraw the liquid. Unfortunately, the use of a nursing bottle can cause tooth decay, also known as dental caries, due to the effect of "pooling" when the liquid stays in contact with the back of a baby's lower front teeth for extended periods such as when the baby falls asleep with the bottle in its mouth. The greater and greater use of baby bottles has lead to an increase in what is known as ECC, or Early Childhood Caries.

Tooth decay is the erosion of the protective enamel surface of the tooth which occurs when the tooth is exposed to an acidic environment. The human mouth contains various types of bacteria, including *Streptococcus mutans*. *S. mutans* bacteria digest simple carbohydrates such as sucrose (table sugar) and produce acidic wastes, such as lactic acid. When a simple carbohydrate is introduced into the mouth, *S. mutans* multiply and their acidic wastes can drastically affect the acidity of the mouth. While the normal pH in the mouth is about 7 (neutral), the pH can drop to about 4 when a concentrated sucrose solution is consumed. Tooth enamel softens and erodes when exposed to a pH less than about 6.5. It can thus be seen that foods and liquids containing simple carbohydrates do not directly cause tooth decay. Instead, they cause a multiplication of *S. mutans*, whose acidic wastes are responsible for the erosion of the tooth enamel. Foods and liquids that contain simple carbohydrates and lead to tooth decay are referred to as cariogenic. Common cariogenic liquids include milk, fruit juices, and sugar-sweetened carbonated sodas.

The amount of tooth enamel erosion that occurs when a cariogenic liquid is consumed is a function of both the acidity in the mouth and the duration of the acidic conditions. These two factors are, in turn, dependent upon the concentration of simple carbohydrates in the liquid, the duration the liquid is in the mouth, and whether the liquid is rinsed or diluted by saliva, water, or other non-cariogenic liquid. When an adult drinks a cariogenic liquid from a glass or bottle, natural swallowing and saliva production help to rinse the cariogenic liquid off the teeth. However, this type of beneficial rinsing is sometimes absent when a baby drinks milk, formula, fruit juice, or other cariogenic liquid from a nursing bottle. When babies drink from a nursing bottle, they tend to fall asleep with the nipple still in their mouths. Both saliva production and swallowing slow or stop during sleep. Accordingly, the conditions in the sleeping baby's mouth are ideal for tooth decay—a cariogenic liquid rich in sugar is present for a long period of time and there is no rinsing of the cariogenic liquid from the teeth. Babies whose care-providers allow them to routinely fall asleep with nursing bottles in their mouths develop tooth decay at an alarming rate. It would be very desirable to provide a nursing bottle that reduced this type of tooth decay even if the baby is allowed to fall asleep with the bottle in its mouth.

SUMMARY OF THE INVENTION

An embodiment of the invention is directed to an apparatus for administering at least two different liquids to a feeding child, comprising (a) a flexible liner having an outer reservoir and an inner reservoir; (b) a valve disposed between the inner and outer reservoirs that opens upon emptying of the outer reservoir under the urging of a vacuum created by the child, thereby allowing flow from the inner reservoir through the outer reservoir and to the child; and (c) a carries-inhibiting rinse agent disposed in the inner reservoir.

Embodiments of the apparatus are also directed to valves that may be any of a burst-type valve, diaphragm-type valve, ball-and-seat valve, duck-bill valve, or an umbrella valve.

Another embodiment of the apparatus is also directed to an apparatus wherein the second reservoir is sealed and the rinse agent comprises a liquid, a liquid concentrate or a powder. The rinse agent may further comprise water and/or a polyol, and the polyol may be xylitol, sorbitol, mannitol or any combination thereof.

Another embodiment of the apparatus includes a container having a cap for holding the flexible liner within the container and a nipple for communication with the contents of the bottle and liner. A typical container is a baby bottle, but other containers such as "sippy cups" may also use this embodiment. The liner preferably is disposable so that washing the two-reservoir liner is unnecessary.

Another embodiment of the apparatus allows either the first or second reservoir to hold the cariogenic liquid, and the other may hold the rinse aid. The selection is made when installing the liner and simply requires the installer to select which of the tabs to fold over the rim of the bottle or cup.

Another embodiment of the apparatus of the present invention is a bottle liner for administering at least two different liquids to a feeding child, comprising a) a first reservoir of polymer fabric, the reservoir comprising two walls sealed together at their mutual bottom and sides and having an open top and flaps extending from both walls at the top of said first reservoir; b) a sheet of polymer fabric having a smaller area than either wall of said first reservoir, the sheet sealingly anchored to the inside of either wall such that the sheet and inner wall together form a second reservoir extending to and open at its top, the sheet also having a flap extending from its wall at the top; and c) a valve in fluid communication with and disposed between the first and second reservoirs such that, when installed in a bottle, the valve opens at the urging of a vacuum created by the child, thereby allowing flow from the second reservoir to the child.

Another embodiment of the apparatus is a bottle liner for administering at least two different liquids to a feeding child, comprising: a) an outer reservoir of polymer fabric, the outer reservoir comprising two walls sealed together at their mutual bottom and sides and having an open top and flaps extending from both walls at the top of the outer reservoir; b) an inner reservoir of polymer fabric, the inner reservoir comprising two walls sealed together at their mutual bottom and sides and having an open top and flaps extending from both walls at the top of the inner reservoir, the inner reservoir located inside of the outer reservoir and anchored to the inside of said outer reservoir such that one of the flaps of the inner reservoir is sealingly attached to a flap of the outer reservoir at its top; and c) a valve in fluid communication with and disposed between the outer and inner reservoirs such that, when the liner is installed in a bottle, the valve opens at the urging of a vacuum created by the child, thereby allowing flow from the inner reservoir to the child.

BRIEF DESCRIPTION OF THE DRAWINGS

FIG. 6 is a schematic depiction of another inner reservoir embodiment having a separate floor with a check valve built in.

DETAILED DESCRIPTION OF EMBODIMENTS OF THE INVENTION

Embodiments of the invention are directed to a bottle liner or insert for administering at least two different liquids to a feeding child, comprising a) a first reservoir of polymer fabric, the reservoir comprising two walls sealed together at their mutual bottom and sides and having an open top and flaps extending from both walls at the top of said first reservoir; b) a sheet of polymer fabric having a smaller area than either wall of said first reservoir, the sheet sealingly anchored to the inside of either wall such that the sheet and inner wall together form a second reservoir extending to and open at its top, the sheet also having a flap extending from its wall at the top; and c) a valve in fluid communication with and disposed between the first and second reservoirs such that, when the liner is installed in a bottle, the valve opens at the urging of a vacuum created by the child, thereby allowing flow from the second reservoir to the child. The design of this disposable insert allows a child to first drink the contents from the first reservoir (normally milk, fruit juice, etc.), then upon emptying the first reservoir, triggering the one-way valve with the child's sucking activity so that the second reservoir is then open to the child. This allows for a rinse aid or other fluid such as water to rinse the child's oral cavity so that tooth decay caused by the cariogenic activity of bacteria feeding on sugars from the milk or juice is decreased by their lessened availability. Alternatively, pharmaceuticals or other therapeutics could be administered to a child in this same manner in place of, or even in addition to, a rinse aid.

Figure 1:
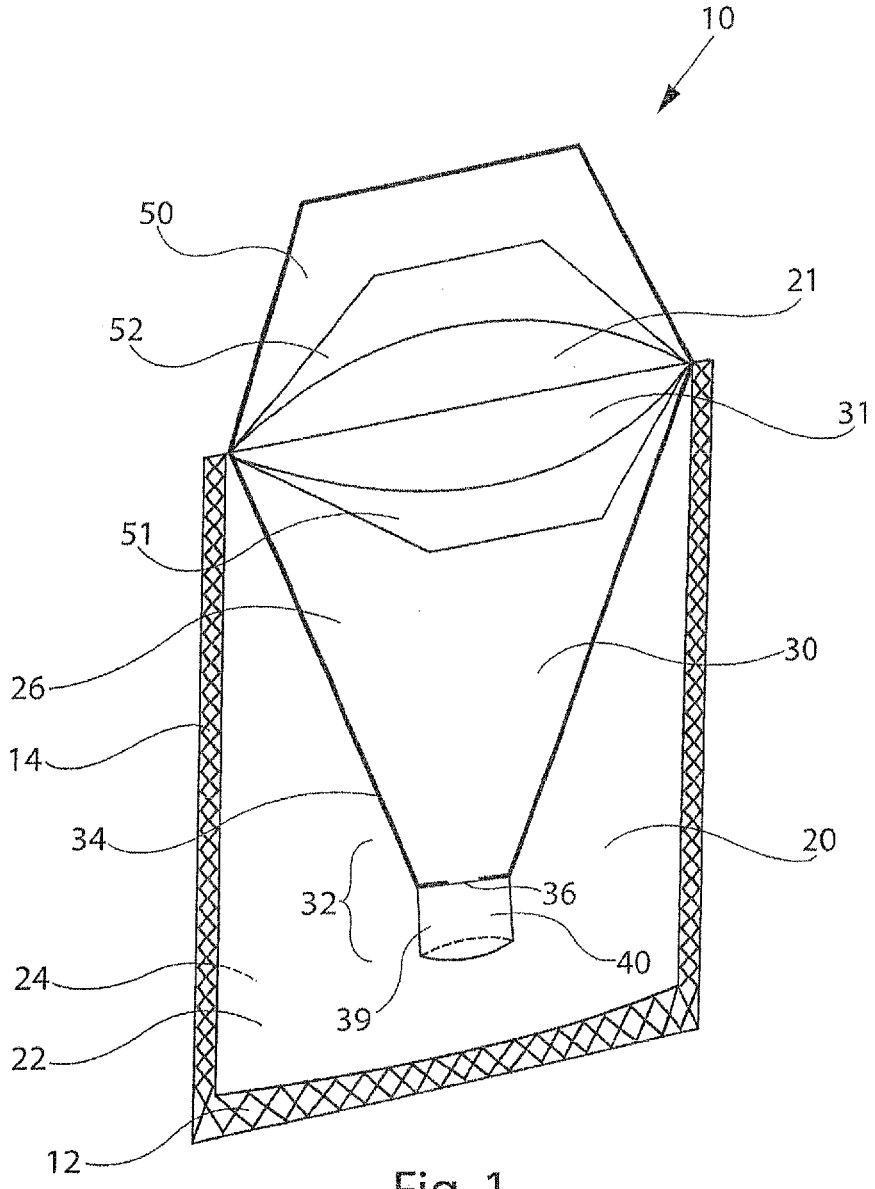
FIG. 1 is a schematic depiction of a polymeric multi-layer liner having two reservoirs connected by a one-way burst-type valve.

FIG. 1 depicts insert 10, a first embodiment of the invention. The insert comprises a first reservoir 20 and a second reservoir 30. The two reservoirs are comprised of a flexible polymeric material such as polyethylene or polypropylene that is food-grade and compatible with hot or cold liquids. The thickness of the flexible polymeric material is sufficient to suspend and hold liquids such as baby formula and water in a liquid-tight manner and is well-known to one of ordinary skill in the art. First and second reservoirs 20 and 30 are of a single piece when used; that is, they are functionally two single reservoirs, but second reservoir 30 is separate from but in fluid communication with the first reservoir 20 through the valve 40, shown here as a burst-type valve located in the neck 32, that is, a weakened area 36 of the second reservoir seal 34 where two layers of polymeric film are sealed, but weakly, so that under approximately 4 pounds of vacuum they separate ("burst"). A conduit 39 is a tube-like extension that operates to channel the flow of liquid from the second reservoir to the area of the nipple. Its length may be varied to 1) avoid mixing with cariogenic liquid from the first reservoir, and 2) modify the flow resistance and hence the flow rate out of the second reservoir.

First reservoir 20 is where the cariogenic liquids such as milk etc. are placed for feeding. First reservoir 20 comprises two walls, front and rear walls 22, 24, respectively, the walls sealed together at their mutual bottom seal 12 and side seal 14 and having an open top of first reservoir 21 and first reservoir rear and front flaps 50, 51, respectively, each flap extending from a wall 24 or 22 at the top of the first reservoir 21. The first reservoir 20 is therefore open at the top 21 so that when installed in a bottle cariogenic liquid may be easily poured into the reservoir. In an alternative embodiment, the second reservoir may hold the cariogenic liquid while the first reservoir holds the rinse aid. This design allows either selection, although in one embodiment the reservoirs may have differing capacities for the anticipated uses. That is, the larger reservoir may be usually used for the cariogenic liquid, while the smaller capacity reservoir may normally be used for the rinse aid. In yet another embodiment, the reservoirs may have equal capacities.

Second reservoir 30 is comprised of a single-layer sheet of polymer fabric having a smaller area than either wall of the first reservoir. The sheet is sealingly anchored to the inside of either wall of the first reservoir such that the sheet and inner wall together form a pocket or "second reservoir" 30 within the first reservoir. The sheet is sealed to the first reservoir's wall by standard polymer attachment techniques such as ultrasonic welding, heat welding, or by using a food-safe adhesive resulting in second reservoir seal 34. The sheet resembles a pocket in that it extends to and is open at its top so that liquids may be easily admitted. The sheet has a middle flap 52 extending from its wall at its top. Middle flap 52 is substantially similar to flaps 50, 51 that extend from the top of first reservoir walls 24, 22, respectively.

In one embodiment second reservoir 30 is unsealed and empty, that is, it comes with a second reservoir middle flap 52 unsealed, so that the user may introduce water or any rinsing agent. In another embodiment top of second reservoir 31 is sealed so that a sealed second reservoir 30*a* is formed (not shown). The sealed second reservoir 30*a* allows for pre-loading a rinse aid such as a concentrated xylitol syrup which could then be diluted immediately prior to use by adding water. In another embodiment the rinse aid could be prepackaged as a dried powder which would be reconstituted with water just prior to use. To add water to the sealed second reservoir, a resealable means for admitting water to the reservoir is necessary, such as a resealable zip-lock closure.

Burst valve 40 is situated in neck 32 of the second reservoir 30 and comprises area of weakness 36 and conduit 39. The neck, being of narrower width than the body of the reservoir, creates a channel for fluid flow that is restricted by the inner diameter of attached conduit 39. In a typical implementation the diameter of conduit 39 may be ½ inch, although diameters from about ¼ to about ¾ inch may work equally well. Varying the conduit's diameter will vary its flow rate. Burst valve 40 is not strictly a one-way valve, meaning that fluid will only flow in one direction, but in practice fluid flows mainly in one direction (first from the first reservoir to the child, then from the second reservoir through the first reservoir and to the child) due to the pressure differential being exerted in one direction only. Liquid flow occurs at the urging of the child, whose sucking on the nipple at the end of the bottle will create the vacuum necessary to pull liquid first from the first reservoir, and then from the second reservoir through the first reservoir. The valve "bursting" or "cracking" pressure must be enough so that the valve does not open during normal consumption of the cariogenic liquid from the first reservoir, but not so high that it will not open when the liquid in the first reservoir is gone and the child is attempting to pull more fluid through the valve. For the burst valve design of the current embodiment, a burst pressure of from 3-6 PSI is effective.

Burst valve designs vary substantially depending on the manufacturing process. In the case of thin polymer films, a weakened area may be made by scoring the material mechanically, using an infrared source to heat melt the material, and by ultrasonic means. The ultimate goal is to weaken a portion of the second reservoir seal 34 which separates the second and first reservoirs so that upon exposure to a minimum vacuum of approximately 4-5 PSI, the weakened portion fails ("bursts"). Any embodiment that achieves this goal is encompassed by the inventive concept herein.

An alternate embodiment to the burst-type valve is a whoopee valve, which is similar to the open neck of a balloon, without the rolled edge. A whoopee valve may be manufactured integral to the neck 32 by forming a long open conduit 39 that is an extension of the neck 32. The conduit may comprise two layers of the same or similar polymeric material as that of the second reservoir. Preferably the material is thin so that the two opposing layers tend to flatten or stick together. A small internal pressure differential between the second reservoir and the first is sufficient to cause the two opposing layers to separate and thereby allow escape of fluid through the whoopee valve. The whoopee valve is normally open but due to its normally flattened configuration and length, little to no fluid from the second reservoir escapes.

Figure 2:
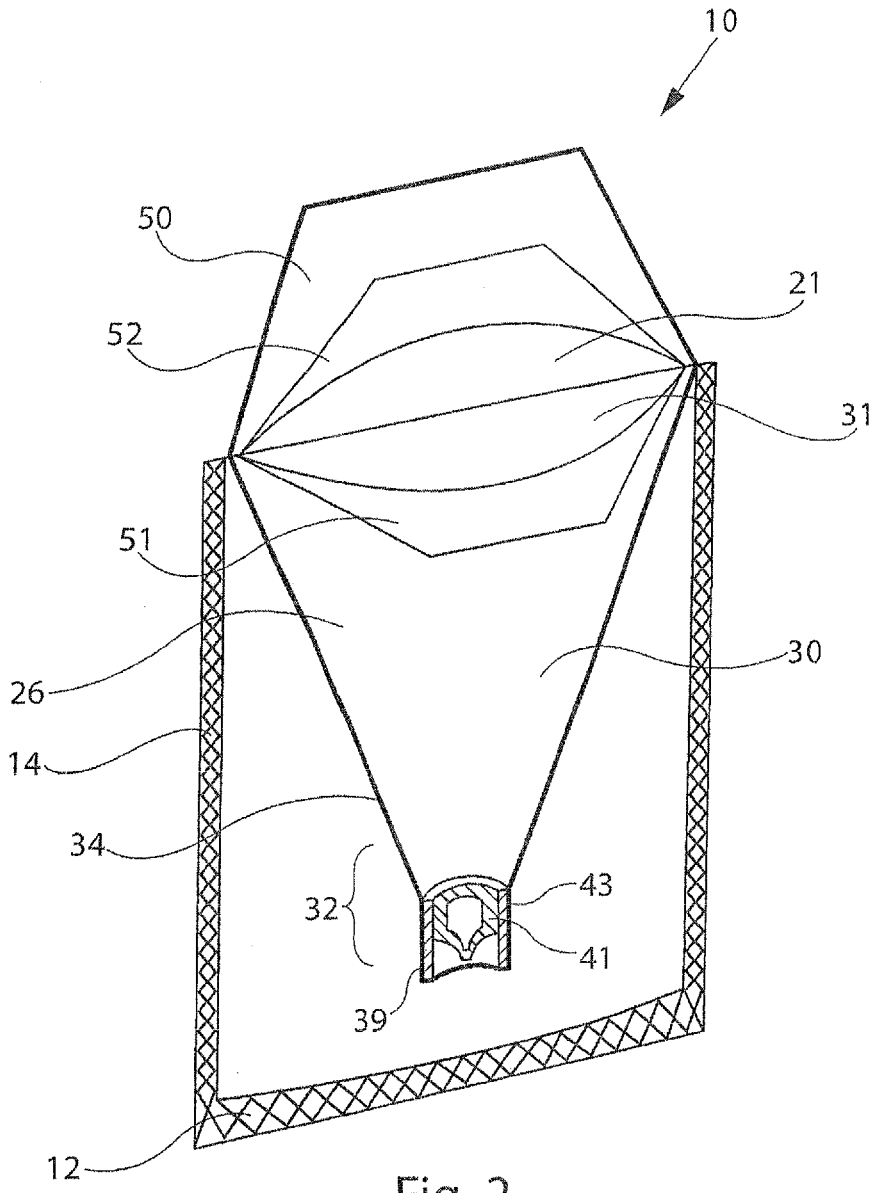
FIG. 2 is a schematic depiction of a polymeric multi-layer liner having two reservoirs connected by a one-way duckbill valve.

Check-type valves may also be used, such as a ball-and-seat valve, duck bill valve, umbrella valve, or diaphragm valve. These valve types are considered to be equivalents, and are solely the choice of the person of ordinary skill in the art. Other check valve choices may be equally substitutable with these, but the choice of exact valve type is deemed to be within the skill of the art. Another embodiment having a different valve is shown in FIG. 2 which is a schematic depiction of a polymeric multi-layer liner having two reservoirs connected by a one-way duckbill check valve 41. Duck bill check valve 41 is mounted in duckbill check valve housing 43, which may be a semi-rigid portion of tubing that is fitted inside the neck 32 of second reservoir 30. The duckbill to check valve 41 is comprised of two primary parts: a cylindrical body portion, and a matched set of progressively thinning and opposed "duckbills" connected to the body. Duckbill check valves allow free flow with positive differential pressure in one direction, and with negative differential pressure backflow is checked. Duckbill check valves are rated in part by the amount of pressure needed to open to a certain diameter and thus a certain flow rate. The opening or "cracking" pressure needed is expected to be in the range of from 3-6 PSI, with a more preferred range of from 4-5 PSI. Duckbill check valves are available from numerous sources, Vernay Laboratories being one such source.

Typical flow rates for a nursing child with a bottle are from about 1 ml/min for premature infants to as much as 50 ml/minute and more, which vary widely depending upon age and size. For example, in Scheel et al.'s research on oral feeding performance of very-low-birthweight infants they found a mean rate of milk transfer of about 1.6 ml/min+/−1.0 ml/min in 10 neonatal infants being an average age of 27 weeks of age, +/−2 weeks using three different nipple types (*Acta Paediatr.* 2005 September; 94(9):1266-1272). Typical sucking vacuum for these infants varied from −70 to −10 mmHg. For older children likely to benefit from the embodiments of the invention described herein, the flow rates would be higher and the vacuums lower. For example, in "Determinants of Milk Flow Through Nipple Units," Mathews measured flow rates through standard nipples at a vacuum of 120 mm $H_2O$ (−4.33 PSI) ranging from 4.5 ml/min. to as much as 53.3 ml/min (*Arch Pediatrics* 144:222-224 (1990)), depending primarily upon the size of the hole in the nipple.

Figure 3:
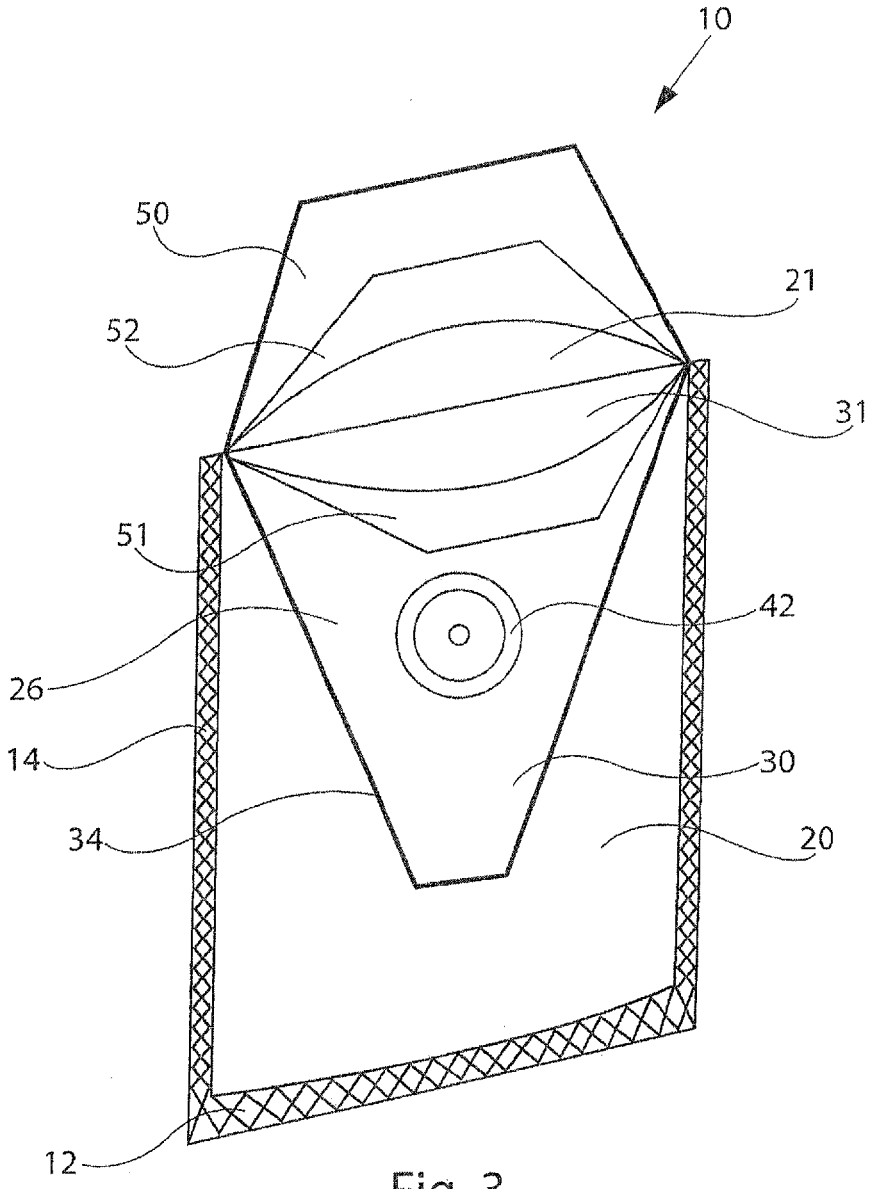
FIG. 3 is a schematic depiction of a polymeric multi-layer liner having two reservoirs connected by a diaphragm-type valve located in the wall of the second reservoir.

Another embodiment having a different valve is shown in FIG. 3 which is a schematic depiction of a polymeric multi-layer liner having two reservoirs connected by a to diaphragm-type check valve 42 located in the interior wall of the second reservoir that separates the contents of second reservoir 30 from first reservoir 20 when they are both filled. The location of diaphragm valve 42 is close to the top of the bottle when the first reservoir is emptied, thereby dispensing its contents directly to the area of the nipple, and bypassing residual cariogenic liquid in the first reservoir. The pressure and flow specifications are the same as previously mentioned. Diaphragm check valves are also available from Vernay Laboratories that meet the specifications for this application.

A fourth embodiment of the invention is directed to a bottle liner for administering at least two different liquids to a feeding child, comprising a) an outer reservoir of polymer fabric, the outer reservoir comprising two walls sealed together at their mutual bottom and sides and having an open top and flaps extending from both walls at the top of the outer reservoir; b) an inner reservoir of polymer fabric, the inner reservoir comprising two walls sealed together at their mutual bottom and sides and having an open top and flaps extending from both walls at the top of the inner reservoir, the inner reservoir located inside of the outer reservoir and anchored to the inside of the outer reservoir such that one of the flaps of the inner reservoir is sealingly attached to a flap of the outer reservoir at its top; and c) a valve in fluid communication with and disposed between the outer and inner reservoirs such that, when said liner is installed in a bottle, the valve opens at the urging of a vacuum created by the child, thereby allowing flow from the inner reservoir to the child. The primary difference between the first and fourth embodiments is this embodiment is modeled on a "bag-within-a-bag" design. The advantage of a bag-in-a-hag is the increased strength of the second reservoir/inner bag; the disadvantage is increased complexity and expense of manufacture. However, either design is within the spirit and scope of the invention.

Figure 4:
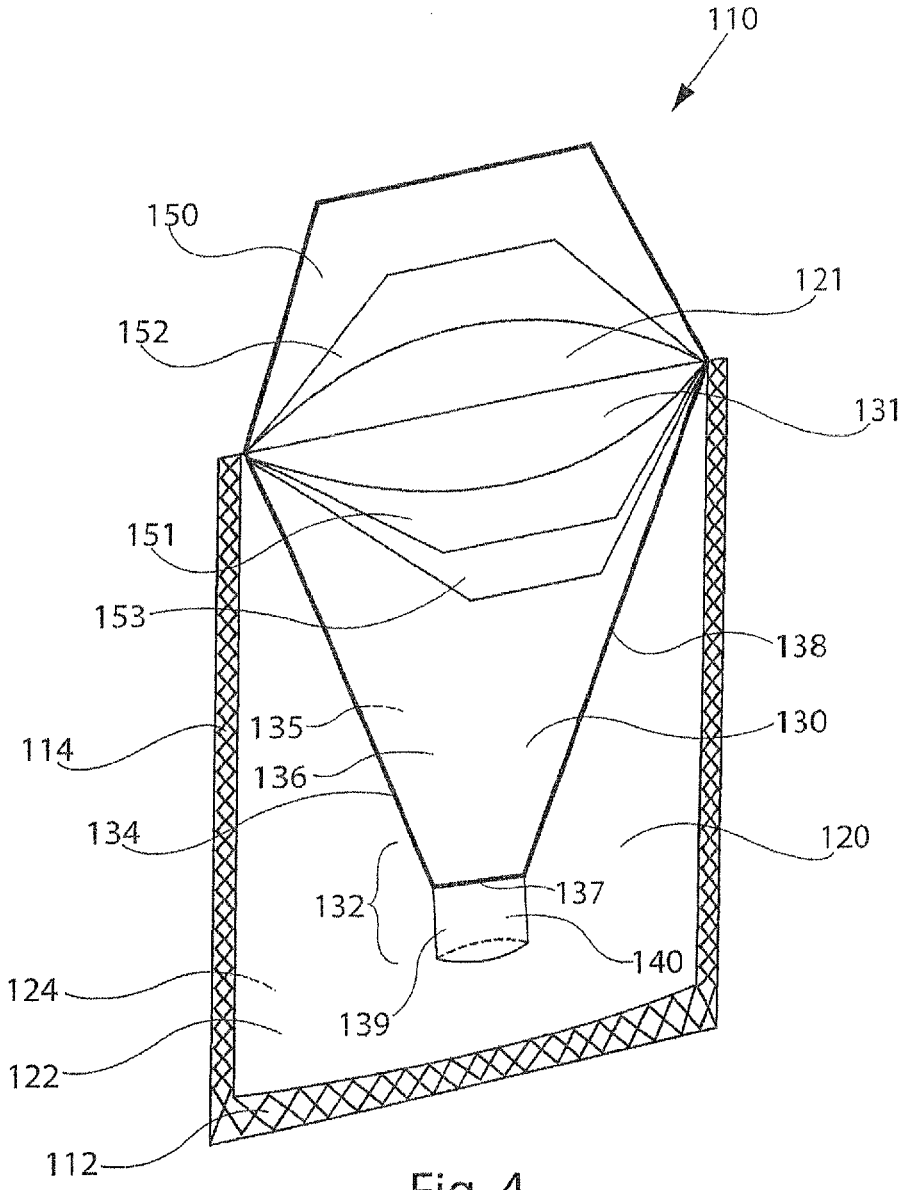
FIG. 4 is a schematic depiction of a second embodiment of a polymeric multi-layer liner having two reservoirs connected by a one-way burst-type valve.

FIG. 4 is a schematic depiction of the fourth insert embodiment 110. Outer reservoir 120 is no different from that of the first embodiment, and like that is made of polymer fabric, outer reservoir 120 comprising front and rear walls 122, 124, respectively, sealed together at their mutual bottom seal 112 and side seal 114 and having an open top 121 and outer reservoir rear and front flaps 150, 153, respectively, extending from both walls at the top of outer reservoir 120. Outer reservoir 120 is therefore open at its top 121 so that when installed in a bottle cariogenic liquid may be easily poured into the reservoir. In an alternative embodiment, the inner reservoir may hold the cariogenic liquid while the outer reservoir holds the rinse aid. This design allows either selection, although in one embodiment the reservoirs may have differing capacities for the anticipated uses. That is, the larger reservoir may be usually used for the cariogenic liquid, while the smaller capacity reservoir may normally be used for the rinse aid. In yet another embodiment, the reservoirs may have equal capacities.

Inner reservoir 130 is comprised of front and rear walls 136, 135, respectively, sealed together at their mutual bottom 137 and sides 138 and having an open top 131 and inner reservoir front and back flaps 151, 152, respectively, each extending from the walls at the top of inner reservoir 130. Inner reservoir 130 is located inside of outer reservoir 120 and is anchored to the inside of outer reservoir 120 such that one of the flaps of the inner reservoir is attached to a flap of the outer reservoir at its top. Attachment of one flap to the other is made by conventional means such as adhesive, heat welding, or ultrasonic welding.

In one embodiment inner reservoir 130 is unsealed and empty, that is, it comes with flaps 151, 152 unsealed, so that the user may introduce water or any rinsing agent. In another embodiment top of inner reservoir 131 is sealed so that a sealed inner reservoir 130*a* is formed (not shown). The sealed inner reservoir 130*a* allows for pre-loading a rinse aid such as a concentrated xylitol syrup which could then be diluted immediately prior to use by adding water. In another embodiment the rinse aid could be pre-packaged as a dried powder which would be reconstituted with water just prior to use. To add water to the sealed inner reservoir, a resealable means for admitting water to the reservoir is necessary, such as a resealable closure such as that disclosed in U.S. Pat. No. 7,073,674 (Knuth et al.), incorporated by reference herein.

Valves that allow one-way transmission of fluid from the inner reservoir 130 to the child that may be used in this embodiment are the same as previously described in relation to the first embodiment, and their discussion is incorporated by reference herein. Thus, burst-type valves, check valves including duckbill, diaphragm, ball-and-seat, umbrella, and any combination of the foregoing are applicable to this fourth embodiment of the insert in the same manner as previously discussed.

Figure 6:
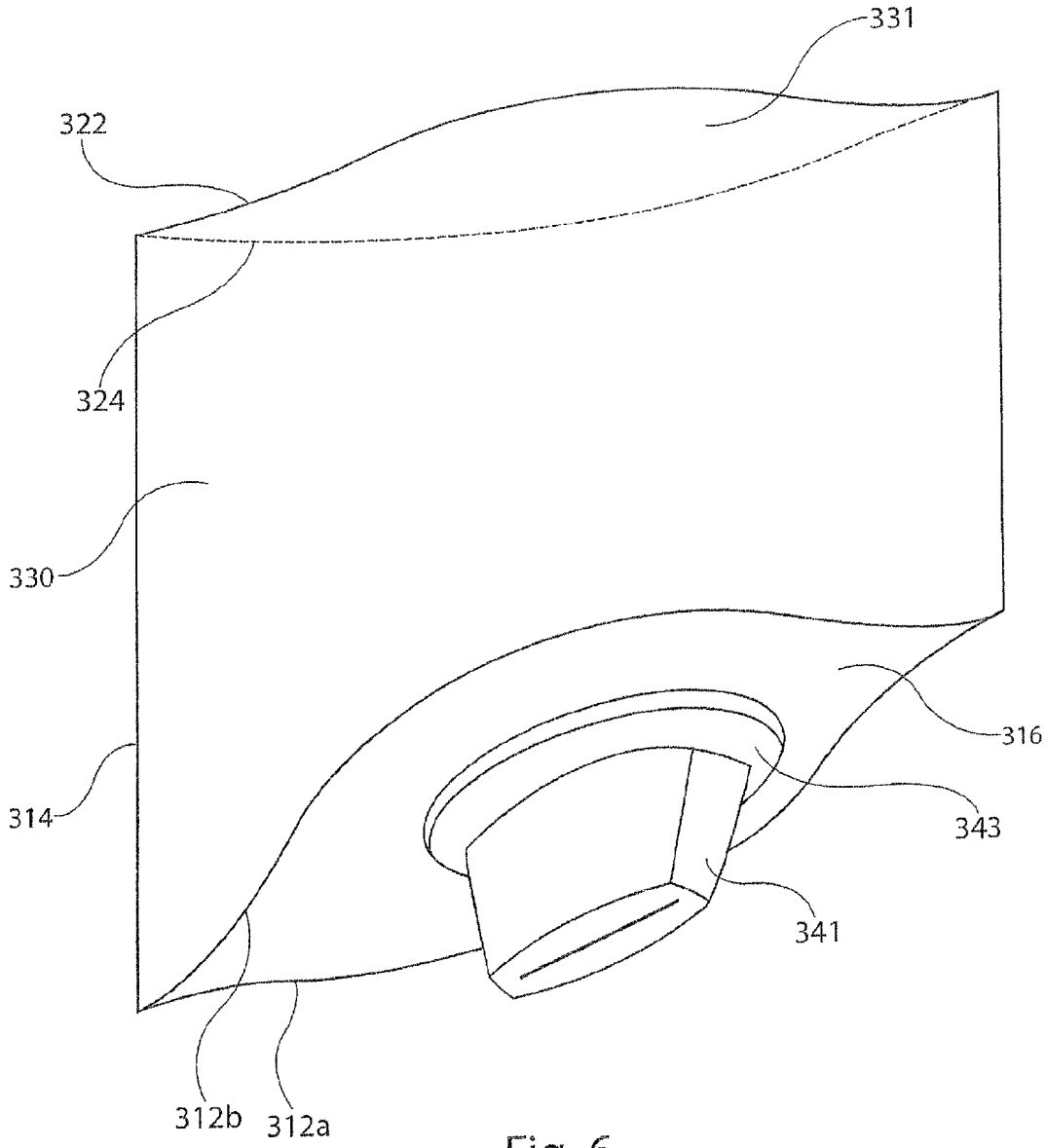

Another embodiment of the bag-in-a-bag design includes the design of FIG. 6 wherein an inner bag having a structurally rigid bottom or floor is used to anchor a check valve. FIG. 6 is a schematic depiction of an inner reservoir component or bag that is comprised of material similar to a "juice bag" or similar structure. The enhanced strength of such material makes the anchoring of a check valve such as the duckbill check valve 341 shown in FIG. 6 more robust. FIG. 6 comprises an inner reservoir 330 similar to second reservoir 230 but having a floor or bottom 316 that is sealed to the front and rear walls 322, 324, respectively of the reservoir at rear and front seals 312*a*, 312*b*, respectively. Rear and front seals 312*a* and 312*b* seal and join the front and rear walls 322, 324, respectively to the bottom 316 at a right angle. Normal sealing processes such as heat staking, ultrasonic welding and adhesives, or any combination thereof, may be used for joinder. The bag is open at its top 331. Not shown are flaps which are necessary for closing the reservoir after filling. Duckbill valve 341 is anchored to bottom 316 preferably at check valve housing 343, which is also joined in a liquid-tight manner to the bottom by any of the aforementioned plastic sealing techniques. Other check valves may also be used herein, such as burst-type, diaphragm, ball-and-seat or umbrella. The check valve will, as previously discussed, operate to allow fluid from the inner reservoir to leave and flow to the area of the nipple after the outer reservoir has been drained and when a sufficient vacuum is exerted to crack the valve open and allow its contents to escape.

Use and dispensing of liquids from the various embodiments of the invention occurs as follows. First, the liner is slipped into a conventional baby bottle having a body and a screwtop holding a nipple. The liner is slipped into the bottle, and the two outer flaps are folded down over and around the top of the bottle thereby anchoring the liner. Given that this embodiment has three flaps, one flap remains in the up position, that being the flap that is used to isolate the second reservoir after filling. Cariogenic liquid is then added to either the first or second reservoirs, depending upon the amount of liquid to be consumed, typically 4-6 ounces. Assuming the first reservoir is filled with cariogenic liquid, then the rinse aid is admitted in the desired amount to the second reservoir, typically 1-3 ounces. The total capacity of the liner can be anywhere from 6-12 ounces, but is typically 8-10 ounces. Now with both reservoirs filled, the last flap is folded down on top of a first reservoir flap such that the second reservoir is thereby isolated from the open mouth of the bottle, yet the first reservoir top remains open. Lastly, the bottle top is installed which typically requires screwing the screwtop onto the neck of the bottle and over the folded flaps. The flaps may also have perforated ears which facilitates their removal prior to giving the bottle to the child such as taught in U.S. Pat. Nos. 5,894,947 and 6,110,091 (Morano), incorporated herein by reference.

As the child inverts the bottle and inserts it into its mouth, it starts to pull fluid from the bottle via the nipple, the first reservoir being open to the nipple area of the bottle top. The cariogenic liquid is consumed and the insert slowly collapses due to the child's suction and the thin film design of the insert. As the first reservoir decreases in size the amount of suction required to withdraw fluid increases until there is no more fluid left. At this point, the child's suction will increase in an effort to pull the remaining fluid out of the first reservoir. However, when little to none is left, the increase in vacuum will trigger the valve to open, thereby allowing the rinse aid to flow to the area of the nipple and thence to the child's mouth. The rinse aid will then have its intended effect, which is to dilute and rinse the cariogenic fluid from the first reservoir out of the child's mouth thereby inhibiting the formation of caries.

Use and dispensing of liquids from the fourth embodiment of the invention is substantially identical to the first through third embodiments, with the following difference. Since this fourth embodiment of the insert has four flaps instead of three, after filling both reservoirs, the user will need to fold both flaps 151, 152 over the same edge of the bottle to isolate the inner reservoir. This means that one side will have three flaps folded down over it, and the other will have only one.

Aside from that operational difference, the filling and use of the fourth insert embodiment is the same in all material respects.

Methods of manufacturing thin-film polymer bottle inserts are well-known, and include the use of various polymer-based bottle liners on the market today, such as those inserts known under the tradenames PLAYTEX® DROP-INS® and the Philips AVENT® Tempo liner. The material for the insert may be any thin sheet or film of elastomeric material such as but not limited to polyolefin resins and blends including Low Density Polyethylene (LDPE), Linear Low Density Polyethylene (LLDPE), Medium Density Polyethylene (MDPE), High Density Polyethylene (HDPE), Polypropylene (PPE), and Ethylene Vinyl Acetate (EVA). A preferred material is a polyethylene resin.

Figure 5A:
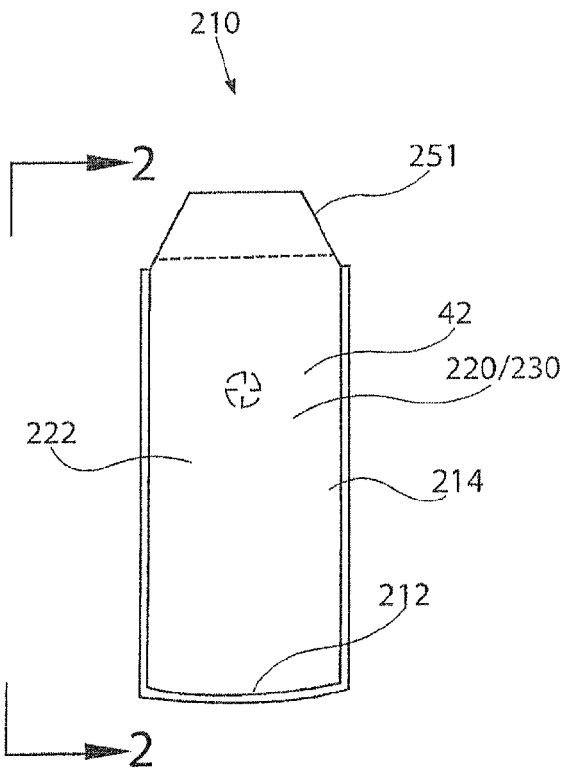
FIG. 5A is a schematic depiction of a frontal view of another three-layer liner embodiment.

FIG. 5A is a schematic depiction of a frontal view of a fifth three-layer liner embodiment. The three-layer liner depicted in FIGS. 5A-B differs from that of the first embodiment of FIGS. 1-4 primarily at its middle wall 226, shown best in FIG. 5B. Liner 210 has three layers that all share the same weld seam at the bottom seal 212 and side seal 214. The three layers each have flaps 250, 251, 252 at their top portions. Middle wall 226 has middle flap 252 extending above the side seal 214. The advantage in this design is that one does not have to perform another sealing step to seal the inner reservoir sheet separately to the front or rear walls 222, 224, respectively. This avoids the possible problem of puncturing the front or rear walls during the sealing step, or risking leakage from the second to the first reservoir due to a faulty seal. This embodiment shows a diaphragm check valve 42 located in middle wall 226, visible in this view due to the transparent nature of the material. As in the previous three-wall embodiment, the child will first drink from first reservoir 220, and then when that fluid has been drained, the additional vacuum will open diaphragm check valve 42 thus allowing fluid to flow from second reservoir 230 to the child. All of the other valve types mentioned herein can also be used with this embodiment, and the diaphragm valve is shown merely for illustration. Some reinforcement may be required to securely hold the valves in place in the middle wall 226 due to the relative thinness of the polymeric material. However, stronger materials could also be used as the middle wall such as multi-laminated material commonly used to hold liquids, such as mylar or laminated aluminum foil, or metal films reinforced with polyethylene, nylon or polypropylene. So long as the three walls may be welded or sealed together at their mutual peripheries, then any material suitable for holding liquid foods is appropriate.

Figure 5B:
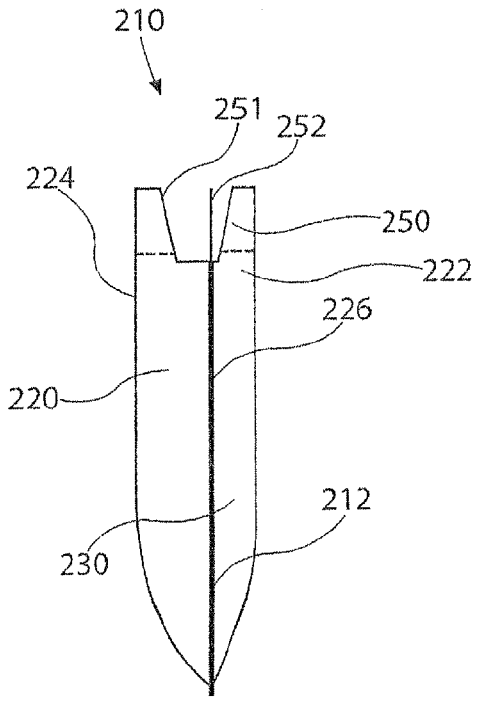
FIG. 5B is a schematic depiction of a side view of the three-layer liner embodiment of FIG. 5A.

FIG. 5B is a schematic depiction of a side view of the three-layer liner embodiment of FIG. 5A. It clearly shows the rear wall 224 which forms the outer portion of first reservoir 220, middle wall 226 which forms the other wall for both reservoirs, and front wall 222 which forms the outer wall for second reservoir 230.

Figure 7:
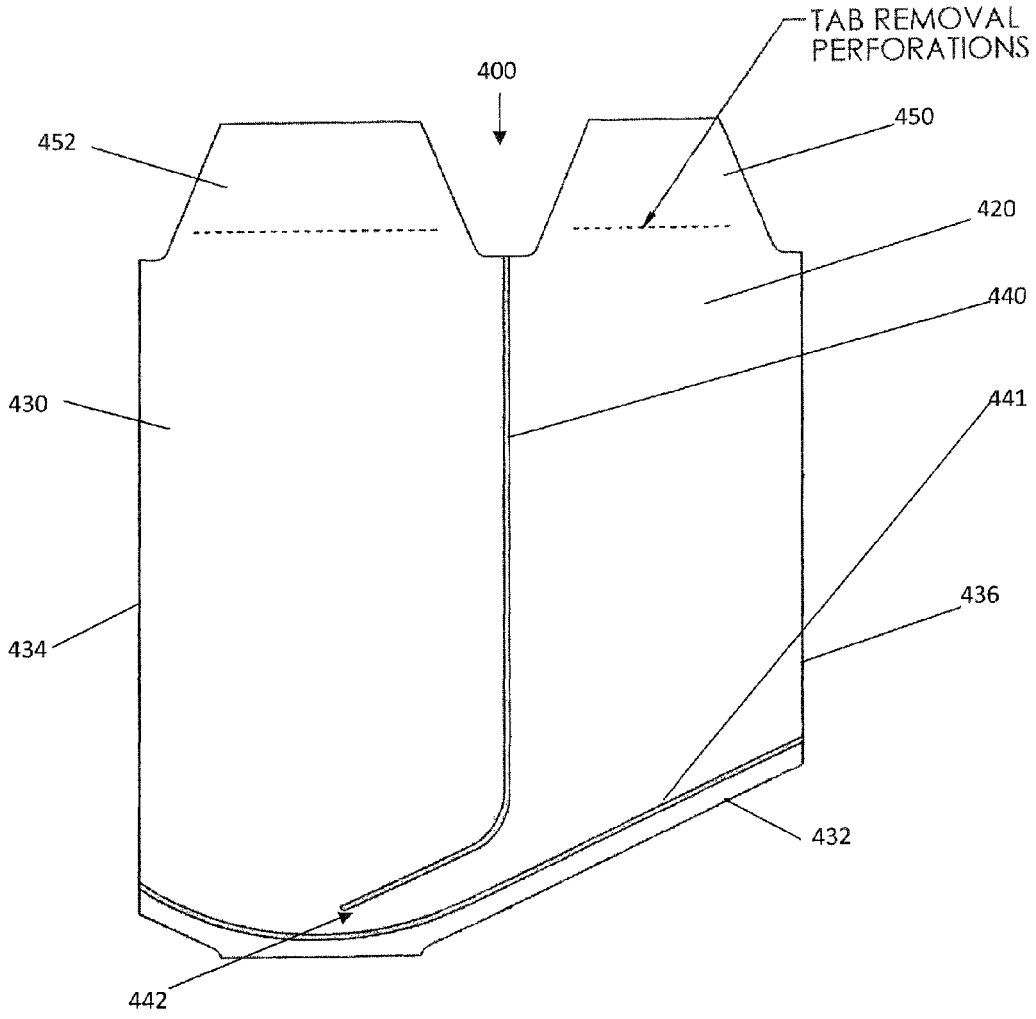
FIG. 7 is a schematic depiction of yet another embodiment of our invention.

FIG. 7 is a schematic depiction of yet another embodiment of the invention. In the FIG. 7 embodiment, the insert 400 comprises a first chamber or reservoir 420 and a second chamber or reservoir 430. As before, the two reservoirs are comprised of a flexible polymeric material such as polyethylene or polypropylene that is food-grade and compatible with hot or cold liquids. Insert 400 is formed from an 8 inch section of a 6 inch tube of plastic, with a heat seal 440 down the middle to create two chambers 420, 430, and a heat seal 441 at the bottom to close it. Alternatively, insert 400 may be formed of two sheets of flexible polymeric material joined at their bottom 432 and side edges 434, 436. In yet another embodiment, insert 400 may comprise a single sheet of flexible polymeric material folded over at one edge, e.g. edge 434 and sealed at the bottom 432 and other edge 436. First and second reservoirs 420, 430 are separated from one another by a sealing bar 440 that runs substantially the height of the reservoirs, but terminates short of the bottom leaving a small gap 442 so that the two reservoirs 420, 430 are separated from one another, but in fluid communication with one another. As in the case of the other embodiments, a burst-type valve or the like may be situated in gap 442. Alternatively, gap 442 may be made sufficiently small, e.g. 3/32-5/32 of an inch, preferably about 1/8 of an inch so that the fluids in the first and second reservoirs 420, 430 normally remain essentially unmixed and separate from one another. Due to the size of the gap, the fluid typically will flow only in one direction, i.e. from the second reservoir to the first reservoir and then to the child, due to a pressure differential being exerted in one direction only, when the child sucks on the nipple at the end of the bottle creating a vacuum necessary to pull liquid first from the first reservoir and then from the second reservoir through the first reservoir, as previously described in connection with the other embodiments.

Other forms of valves such as a whoopee valve or other check-type valve, e.g. a diaghragm-type valve, a ball-and-seat valve, a duck-bill valve, or an umbrella valve, which are given as exemplary, may be used. However, an advantage of the FIG. 7 embodiment is that by making the gap sufficiently small, e.g. about 1/8 inch, the need for a separate valve may be eliminated.

Completing the insert are tabs 450, 452 which permit introduction of fluids into the first and second reservoirs 420, 430, respectively.

Another embodiment of the invention is directed to a carries-inhibiting rinse agent that may be included in the sealed second or inner reservoirs. Carrie-inhibiting rinse agents include the family of polyols, also known as "sugar alcohols," which are polysaccharides having alcohol moieties. An effective polyol, and one that is an included embodiment hereunder is xylitol. The family of polyols that are food-grade includes but is not limited to erythritol, hydrogenated starch hydrolysates (sometimes listed as maltitol syrup, hydrogenated glucose syrup, or simply "HSH"), isomalt, lactitol, mannitol, sorbitol and xylitol.

Erythritol is currently used as a bulk sweetener in reduced calorie foods. It occurs naturally in fruits such as pears, melons and grapes, as well as foods such as mushrooms and fermentation-derived foods such as wine, soy sauce and cheese. Since 1990, erythritol has been commercially produced and added to foods and beverages to provide sweetness, as well as enhance their taste and texture. Erythritol is available in the U.S. and globally from Cargill Inc. and Jungbunzlauer.

Erythritol is a white crystalline powder with a clean sweet taste that is similar to sucrose. It is approximately 70% as sweet as sucrose and flows easily due to its non-hygroscopic character. Like other polyols, erythritol does not promote tooth decay and is safe for people with diabetes. However, erythritol's caloric value of zero calories per gram and high digestive tolerance distinguishes it from other polyols. Because erythritol is rapidly absorbed in the small intestine and rapidly eliminated by the body within 24 hours, laxative side effects sometimes associated with excessive polyol consumption are unlikely when consuming erythritol containing foods.

Hydrogenated starch hydrolysates (HSH) or polyglycitols, including hydrogenated glucose syrups, maltitol syrups, and sorbitol syrups, are a family of products found in a wide variety of foods. They serve a number of functional roles, including use as bulk sweeteners, viscosity or bodying agents, humectants, crystallization modifiers, cryoprotectants and rehydration aids. They also can serve as sugar-free carriers for flavors, colors and enzymes. HSH were developed by a Swedish company in the 1960's and have been used by the food industry for many years, especially in confectionery products.

HSH are produced by the partial hydrolysis of corn, wheat or potato starch and subsequent hydrogenation of the hydrolysate at high temperature under pressure. The end product is an ingredient composed of sorbitol, maltitol and higher hydrogenated saccharides (maltitriitol and others). By varying the conditions and extent of hydrolysis, the relative occurrence of various mono-, di-, oligo- and polymeric hydrogenated saccharides in the resulting product can be obtained. A wide range of polyols (also known as sugar alcohols) that can satisfy varied requirements with respect to different levels of sweetness, viscosity and humectancy can, therefore, be produced.

The term "hydrogenated starch hydrolysate" can correctly be applied to any polyol produced by the hydrogenation of the saccharide products of starch hydrolysis. In practice, however, certain polyols such as sorbitol, mannitol and maltitol are referred to by their common chemical names. "Hydrogenated starch hydrolysate" is more commonly used to describe the broad group of polyols that contain substantial quantities of to hydrogenated oligo- and polysaccharides in addition to any monomeric or dimeric polyols (sorbitol, mannitol or maltitol, respectively).

The broad term HSH does not differentiate polyols having, for example, different levels of sweetness nor does it identify the principle polyol in the HSH. Common names for major HSH subgroups have, therefore, been developed. These common names are generally based on the most prevalent polyol comprising the HSH. For example, polyols containing sorbitol as the majority (50 percent or more) component are called sorbitol syrups; those with maltitol as the majority component are called maltitol syrups, maltitol solutions or hydrogenated glucose syrups. Polyols that do not contain a specific polyol as the majority component continue to be referred to by the general term "hydrogenated starch hydrolysate."

In the United States, HSH are provided by three manufacturers, Archer Daniels Midland Company (ADM), Corn Products Specialty Ingredients and Roquette America, Inc. Maltitol syrups may contain 55-65% maltitol and sorbitol syrup may contain 70-75% sorbitol.

Polyols, including HSH, are resistant to metabolism by oral bacteria that break down sugars and starches to release acids that may lead to cavities or erode tooth enamel. They are, therefore, non-cariogenic. The usefulness of polyols as alternatives to sugars and as a part of a comprehensive program including proper dental hygiene has been recognized by the American Dental Association. In one recent clinical study of the effect of xylitol given to toddlers from 9 to 15 months of age, a xylitol syrup administered twice daily for a total of 8 g/d could prevent up to 70% of decayed teeth (Milgrom, P. et al., *Arch. Pediatr. Adolesc. Med.* 2009; 163(7):601-607). Furthermore, an independent review of four randomized controlled clinical studies found that xylitol has efficacy in reducing the incidence of acute otitis media when administered either as a syrup formulation at 10 g/d or via chewing gum (Danhauer J L, et al., *Int. J. Audiol. October* 2010 (49)10:754-61).

It will be understood that various modifications may be made to the embodiments disclosed herein. Therefore, the above description should not be construed as limiting, but merely as exemplifications of preferred embodiments. Those skilled in the art will envision other modifications that come within the scope and spirit of the claims appended hereto. All patents and references cited herein are explicitly incorporated by reference in their entirety.

PARTS LIST TABLE

| | |
|---|---|
| 10 | Insert |
| 12 | Bottom Seal |
| 14 | Side Seal |
| 20 | First reservoir |
| 21 | Top of First Reservoir |
| 22 | Front Wall |
| 24 | Rear Wall |
| 26 | Middle Wall |
| 30 | Second Reservoir |
| 30a | Sealed Second Reservoir |
| 31 | Top of Second Reservoir |
| 32 | Neck |
| 34 | Second Reservoir Seal |
| 36 | Weakened Area |
| 39 | Conduit |
| 40 | Valve |
| 41 | Duckbill Check Valve |
| 42 | Diaphragm Check Valve |
| 43 | Duckbill Check Valve Housing |
| 44 | |
| 46 | |
| 48 | |
| 50 | First Reservoir Rear Flap |
| 51 | First Reservoir Front Flap |
| 52 | Second Reservoir Middle Flap |
| 53 | |
| 110 | Second Insert |
| 112 | Bottom Seal |
| 114 | Side Seal |
| 120 | Outer Reservoir |
| 121 | Top of First Reservoir |
| 122 | Outer reservoir front wall |
| 124 | Outer reservoir rear wall |
| 130 | Inner Reservoir |
| 130a | Sealed Inner Reservoir |
| 131 | Top of Inner Reservoir |
| 135 | Inner Reservoir Rear Wall |
| 136 | Inner Reservoir Front Wall |
| 137 | Bottom of Inner Reservoir |
| 138 | Sides of Inner Reservoir |
| 150 | Outer reservoir Rear Flap |
| 151 | Inner reservoir front flap |
| 152 | Inner reservoir Back Flap |
| 153 | Outer reservoir Front Flap |
| 210 | Liner |
| 212 | Bottom seal |
| 214 | Side seal |
| 220 | First reservoir |
| 222 | Front wall |
| 224 | Rear wall |
| 226 | Middle wall |
| 230 | Second reservoir |
| 250 | Rear Flap |
| 251 | Front flap |
| 252 | Middle flap |
| 312a | Rear Seal |
| 312b | Front Seal |
| 314 | Side seal |
| 316 | Bottom |
| 322 | Front Wall |
| 324 | Rear Wall |
| 330 | Inner Reservoir |
| 331 | Top of inner reservoir |
| 341 | Duckbill check valve |
| 343 | Duckbill check valve housing |

I claim:

1. A bottle liner for administering at least two different liquids to a feeding child, comprising:

(a) a first reservoir, said reservoir comprising two sheets sealed together at their mutual bottom and sides, and having an open top and flaps extending from both walls at the top of said first reservoir;

(b) a second reservoir, said second reservoir comprising two sheets sealed together at their mutual bottom and sides, and having an open top and flaps extending from both walls at the top of said second reservoir, said first reservoir and said second reservoir sharing a common sealing wall; and (c) a passageway in said common sealing wall in fluid communication with and disposed between said first and said second reservoirs whereby, when said liner is installed in a bottle, the passageway opens at the urging of a vacuum created by the child, thereby allowing flow from the first reservoir to the second reservoir.

2. The bottle liner of claim 1, wherein the passageway between the first and the second reservoirs is formed of a thin layer of sheet material which tends to flatten or stick together.

3. The bottle liner of claim 2, wherein a small internal pressure differential between the first reservoir and the second reservoir is sufficient to cause the two opposing layers to separate and thereby allow flow of fluid through the passageway.

4. The bottle liner of claim 1, wherein the sheets are formed of a polymer fabric.

5. The bottle liner of claim 4 wherein the polymer fabric is food grade, preferably polyethylene.

6. The bottle liner of claim 1 wherein the flaps have tear-off edges.

7. The bottle liner of claim 1 wherein the second reservoir has a smaller capacity than the first reservoir.

8. The bottle liner of claim 1 wherein the common wall includes a welded seam.

9. The bottle liner of claim 1 wherein the second reservoir contains a liquid rinse agent or a powdered rinse agent sealed therein.

10. The bottle liner of claim 9 wherein the rinse agent liquid comprises a concentrate or is fully diluted.

11. The bottle liner of claim 9 wherein the rinse agent comprises water or a polyol, preferably selected from the group consisting of xylitol, sorbitol and mannitol and combinations thereof.

12. The bottle liner of claim 9 in combination with a container having a cap for holding the flexible liner within said container, and a simulated nipple for communication with the contents of the bottle and liner.

13. The bottle liner of claim 9 wherein the liner is disposable.

* * * * *